US006570995B2

(12) United States Patent
Ohashi et al.

(10) Patent No.: US 6,570,995 B2
(45) Date of Patent: May 27, 2003

(54) SPEAKER DEVICE

(75) Inventors: Yoshio Ohashi, Kanagawa (JP); Masaru Uryu, Chiba (JP)

(73) Assignee: Sony Corporation, Tokyo (JP)

( * ) Notice: Subject to any disclaimer, the term of this patent is extended or adjusted under 35 U.S.C. 154(b) by 15 days.

(21) Appl. No.: 10/054,039

(22) Filed: Nov. 13, 2001

(65) Prior Publication Data

US 2002/0118857 A1 Aug. 29, 2002

(30) Foreign Application Priority Data

Nov. 14, 2000 (JP) ..... 2000-347069

(51) Int. Cl.[7] ..... H04R 1/00
(52) U.S. Cl. ..... 381/430
(58) Field of Search ..... 381/396, 398, 381/400, 403, 405, 412, 417, 418, 420, 423, 430

(56) References Cited

U.S. PATENT DOCUMENTS 3,780,232 A * 12/1973 Ward ..... 381/430
3,790,724 A * 2/1974 Schenkel ..... 381/430
3,955,055 A * 5/1976 Kawakami et al. ..... 381/430
4,752,963 A * 6/1988 Yamakazi et al. ..... 381/430
5,150,419 A * 9/1992 Kizak et al. ..... 381/430
6,320,972 B1 * 11/2001 Goller ..... 381/430

* cited by examiner

*Primary Examiner*—Rexford Barnie
(74) *Attorney, Agent, or Firm*—Jay H. Maioli

(57) ABSTRACT

A speaker device includes a speaker diaphragm composed of a selected acoustic diaphragm material whose acoustic loss coefficient (tan δ) is more than 0.02 in a frequency band over 20 kHz, and including a dome positioned at the center of the diaphragm and shaped to be substantially arcuate in its cross section, with an edge positioned outside the dome and formed integrally therewith through a link; and a conductive one-turn ring inserted into a magnetic gap and bonded fixedly, at one end thereof, to the link between the dome and the edge of the speaker diaphragm. In this device, signals of a frequency band over 20 kHz are reproduced by utilizing the split vibrations of the speaker diaphragm.

2 Claims, 7 Drawing Sheets

SPEAKER DEVICE

BACKGROUND OF THE INVENTION

The present invention relates to a speaker device adapted for reproducing acoustic signals of a frequency band over 20 kHz.

There have been known heretofore such speaker devices as those shown in FIGS. 7, 8 and 9 for reproducing acoustic signals of a frequency band over 20 kHz.

The example of FIG. 7 shows a dynamic speaker device wherein its magnetic circuit includes a doughnut-shaped magnet 1, first and second magnetic yokes 2, 3 composed of a magnetic material such as iron, and a magnetic gap 4. The first magnetic yoke 2 includes a cylindrical center pole 2*a* and a discoidal flange 2*b* orthogonal to the center pole 2*a*.

The second magnetic yoke 3 is termed a plate which is shaped like a doughnut whose inside diameter is greater than the outside diameter of the center pole 2*a* by a length corresponding to the magnetic gap 4.

In a state where the center pole 2*a* is inserted into the inner hollow portion of the magnet 1 and the inner hollow portion of the plate 3, the magnet 1 is attached fixedly while being held between the upper surface of the flange 2*b* and the lower surface of the plate 3. The contact portions of the magnet 1 are bonded to the upper surface of the flange 2*b* and the lower surface of the plate 3.

In order to reproduce signals of a frequency band over 20 kHz, a speaker diaphragm 7 of the speaker device is composed of an adequate acoustic diaphragm material having a great modulus of elasticity so as to raise the split vibration start frequency as high as possible. For this purpose, the speaker diaphragm is composed of a selected acoustic vibration material including ceramics such as SiC or carbon graphite, or metallic one such as aluminum or titanium.

The speaker diaphragm 7 in this example is composed of the acoustic diaphragm material mentioned above, wherein a dome 7*a* positioned at the center and shaped to be substantially arcuate in its cross section, and an edge 7*b* positioned outside the dome 7*a,* are formed integrally with each other through a link 7*c*.

Further an upper end of a cylindrical voice coil bobbin 5, which is composed of a non-conductor, is bonded fixedly with a bonding agent 9 to an inner periphery of the dome 7*a* of the speaker diaphragm 7, and a voice coil 6 wound around the voice coil bobbin 5 at a predetermined position thereof is inserted into the magnetic gap 4 formed between the plate 3 and the center pole 2*a*. Further the outer periphery of the edge 7*b* of the speaker diaphragm 7 is bonded fixedly to a speaker frame 8.

In the speaker device shown in FIG. 7, a current is caused to flow in the voice coil 6 as an acoustic signal is supplied to the voice coil 6, and the speaker diaphragm 7 is vibrated by the interaction of the voice coil 6 and the magnetic flux in the gap 4, thereby emitting sound from the diaphragm 7.

FIGS. 8 and 9 show electromagnetic induction type speaker devices respectively. In explaining the examples of FIGS. 8 and 9, any component parts corresponding to those in FIG. 7 are denoted by the same reference numerals, and a detailed description thereof will be omitted below.

In FIG. 8, an upper end of a cylindrical voice coil bobbin 10, which is composed of a non-conductor, is bonded fixedly to an inner periphery of a dome 7*a* of a speaker diaphragm 7, and a conductive one-turn ring 11 adhered to a predetermined position on the inner peripheral face of the bobbin 10 is inserted into a magnetic gap 4 formed between a plate 3 and a center pole 2*a*. Further a driving coil 12 is wound around a position corresponding, in the magnetic gap 4, to the outer periphery of the center pole 2*a,* and acoustic signals are supplied to the driving coil 12. Other component parts are structurally the same as those in FIG. 7.

When acoustic signals are supplied to the driving coil 12 in the speaker device shown in FIG. 8, the conductive one-turn ring 11 is vibrated by the action of electromagnetic induction, so that the speaker diaphragm 7 is vibrated to emit sound therefrom.

FIG. 9 shows another example wherein an upper end of a cylindrical conductive one-turn ring 13 is bonded fixedly to an inner periphery of a dome 7*a* of a speaker diaphragm 7, and this conductive one-turn ring 13 is inserted into a magnetic gap 4 formed between a plate 3 and a center pole 2*a*. In FIG. 9, any other component parts are structurally the same as those in FIG. 8. The device of FIG. 9 performs the same operation as that of FIG. 8.

In the conventional speaker diaphragm 7 composed of such ceramic or metallic material, the acoustic loss coefficient (1/Q) is extremely small as less than 0.01. For this reason, there exists a disadvantage that, in the frequency band where split vibrations are generated, the sound pressure characteristic indicates a sharp and great peak dip derived from the influence of the split vibrations.

The speaker diaphragm 7 having such dome 7*a* and edge 7*b* is produced by integrally molding a thin sheet or the like. Therefore, the link 7*c* between the dome 7*a* and the edge 7*b* is rendered thinner as the sheet or the like is stretched in two directions.

Further when an acoustic signal is supplied to the voice coil 6 and the driving coil 12 in the above structure where the respective upper ends of the voice coil bobbin 5, the bobbin 10 and the conductive one-turn ring 13 are bonded fixedly to the inner periphery of the dome 7*a* of the speaker diaphragm 7, the dome 7*a* and the edge 7*b* are vibrated with 180° phase difference at a certain frequency while the link 7*c* having a small mechanical strength acts as a node, so that the sound pressure generated from the dome 7*a* and the sound pressure from the edge 7*b* at the relevant frequency cancel each other out to consequently cause a sound pressure dip, thereby deteriorating the tone quality.

SUMMARY OF THE INVENTION

The present invention has been accomplished in view of the problems mentioned above. It is an object of the invention to minimize the peak dip of sound pressure derived from split vibrations of the speaker diaphragm, and also to realize satisfactory reproduction of acoustic signals in a frequency band over 20 kHz.

According to one aspect of the present invention, there is provided a speaker device which includes a speaker diaphragm composed of a selected acoustic diaphragm material whose acoustic loss coefficient (tan δ) is more than 0.02 in a frequency band over 20 kHz, and including a dome positioned at the center and shaped to be substantially arcuate in its cross section, and an edge positioned outside the dome and formed integrally therewith through a link; and a conductive one-turn ring inserted into a magnetic gap and bonded fixedly, at one end thereof, to the link between the dome and the edge of the speaker diaphragm. This speaker device is capable of reproducing acoustic signals of a frequency band over 20 kHz by utilizing the split vibrations of the speaker diaphragm.

In the present invention where the speaker diaphragm is composed of a selected acoustic diaphragm material having an acoustic loss coefficient (1/Q) of more than 0.02 in a frequency band over 20 kHz, it becomes possible to minimize the peak dip of sound pressure derived from the split vibrations of the speaker diaphragm in a frequency band over 20 kHz. Further since one end of the conductive one-turn ring is bonded fixedly to the link between the dome and the edge of the speaker diaphragm, the mechanical strength of the link can be increased to consequently eliminate undesired vibrations with 180° phase difference in the dome and the edge, hence ensuring high-quality reproduction of signals in a frequency band over 20 kHz According to another aspect of the present invention, there is provided a speaker device which includes a speaker diaphragm composed of a selected acoustic diaphragm material whose acoustic loss coefficient (tan δ) is more than 0.02 in a frequency band over 20 kHz, and including a dome positioned at the center and shaped to be substantially arcuate in its cross section, and an edge positioned outside the dome and formed integrally therewith through a link; and a bobbin having a wound voice coil or an adhered conductive one-turn ring disposed in a magnetic gap, and bonded fixedly, at one end thereof, to the link between the dome and the edge of the speaker diaphragm. This speaker device is capable of reproducing acoustic signals of a frequency band over 20 kHz by utilizing the split vibrations of the speaker diaphragm.

In the present invention where the speaker diaphragm is composed of a selected acoustic diaphragm material having an acoustic loss coefficient (1/Q) of more than 0.02 in a frequency band over 20 kHz, it becomes possible to minimize the peak dip of sound pressure derived from the split vibrations of the speaker diaphragm in a frequency band over 20 kHz. Further, since one end of the voice coil bobbin having the wound voice coil or one end of the bobbin having the adhered conductive one-turn ring is bonded fixedly to the link between the dome and the edge of the speaker diaphragm, the mechanical strength of the link can be increased to consequently eliminate undesired vibrations with 180° phase difference in the dome and the edge, hence ensuring high-quality reproduction of acoustic signals in a frequency band over 20 kHz.

The above and other features and advantages of the present invention will become apparent from the following description which will be given with reference to the illustrative accompanying drawings.

DESCRIPTION OF THE PREFERRED EMBODIMENTS

Figure 7:
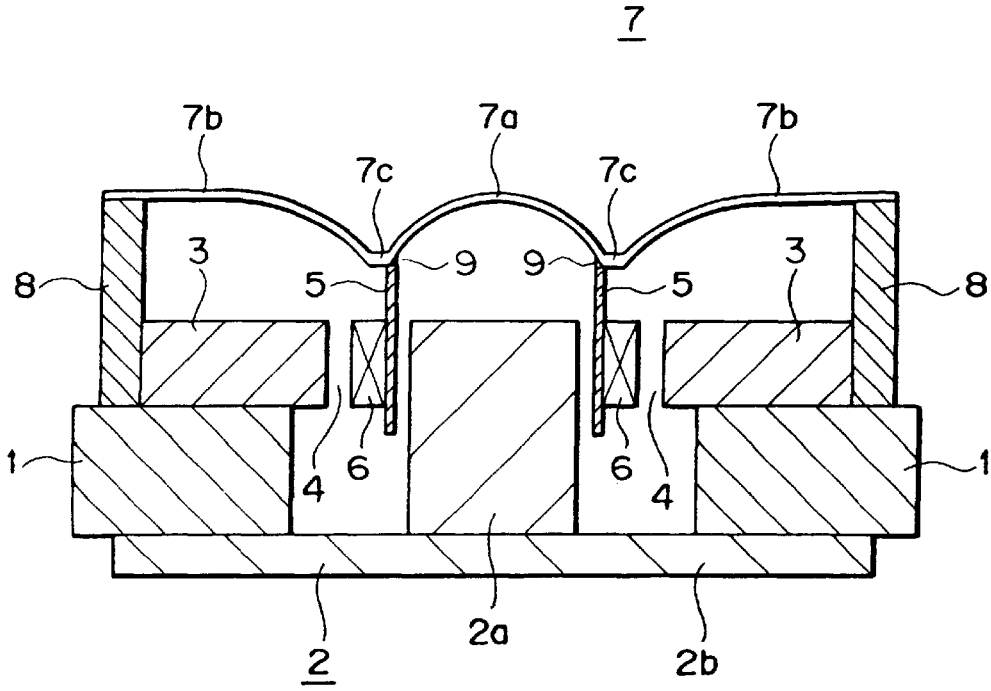
FIG. 7 is a sectional view showing a conventional speaker device.
Figure 8:
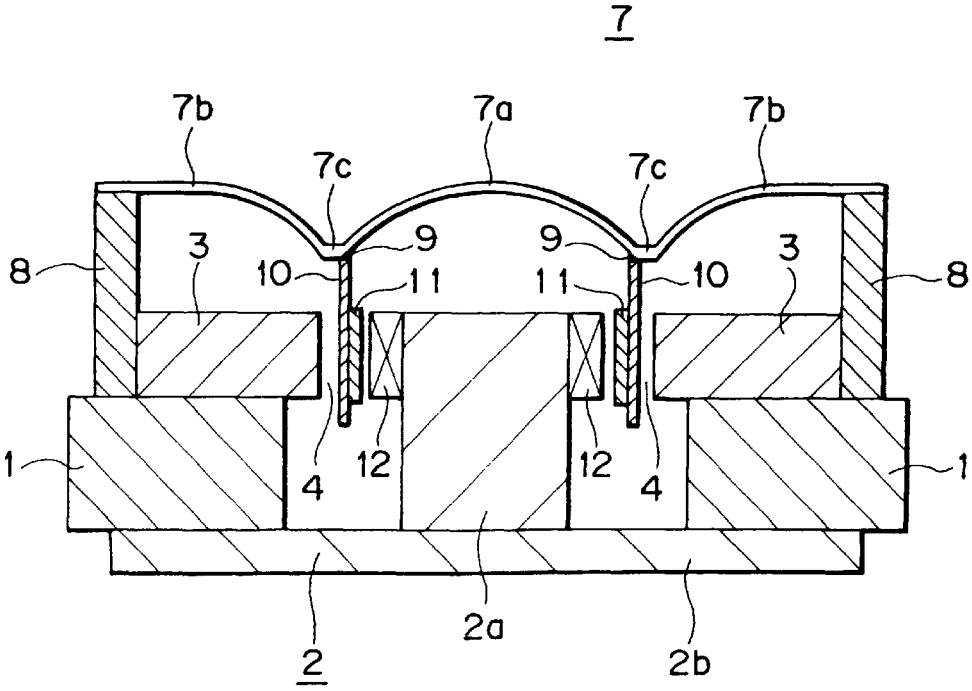
FIG. 8 is a sectional view showing another conventional speaker device.
Figure 9:
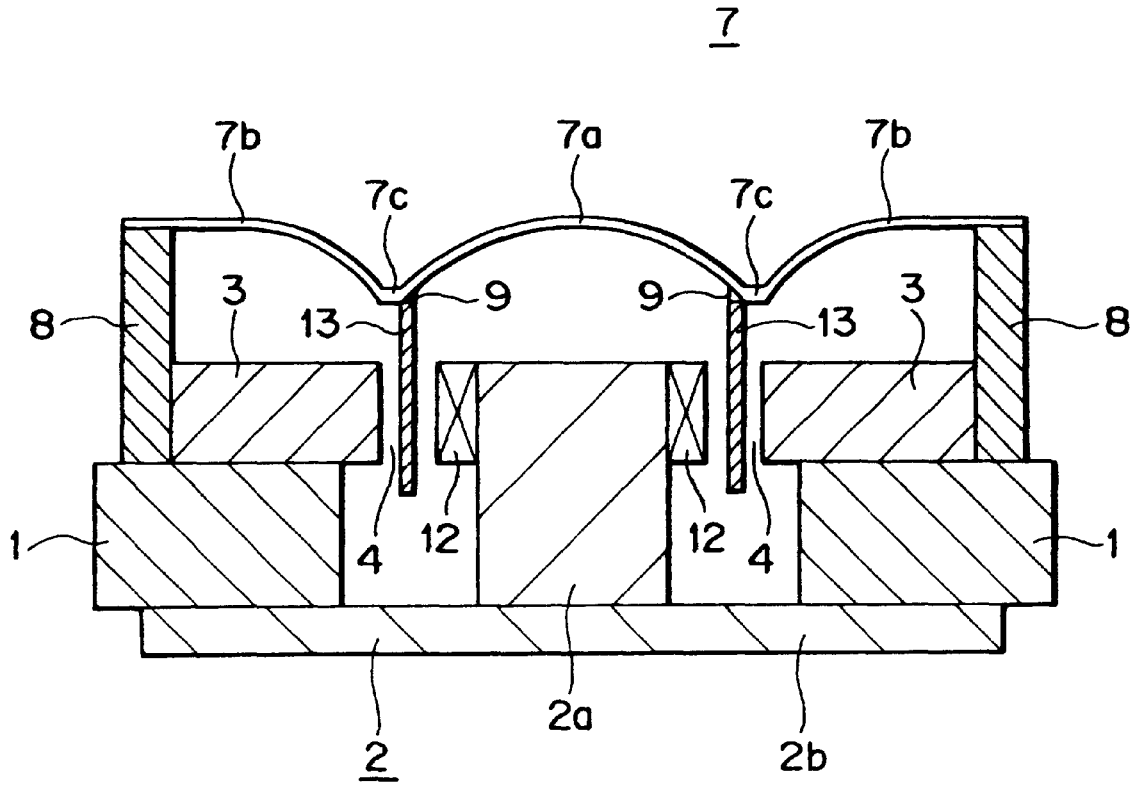
FIG. 9 is a sectional view showing a further conventional speaker device.

Hereinafter some preferred embodiments representing the speaker device of the present invention will be described in detail with reference to FIGS. 1 to 4. First in FIG. 1, any component parts corresponding to those in FIGS. 7 to 9 are denoted by the same reference numerals.

Figure 1:
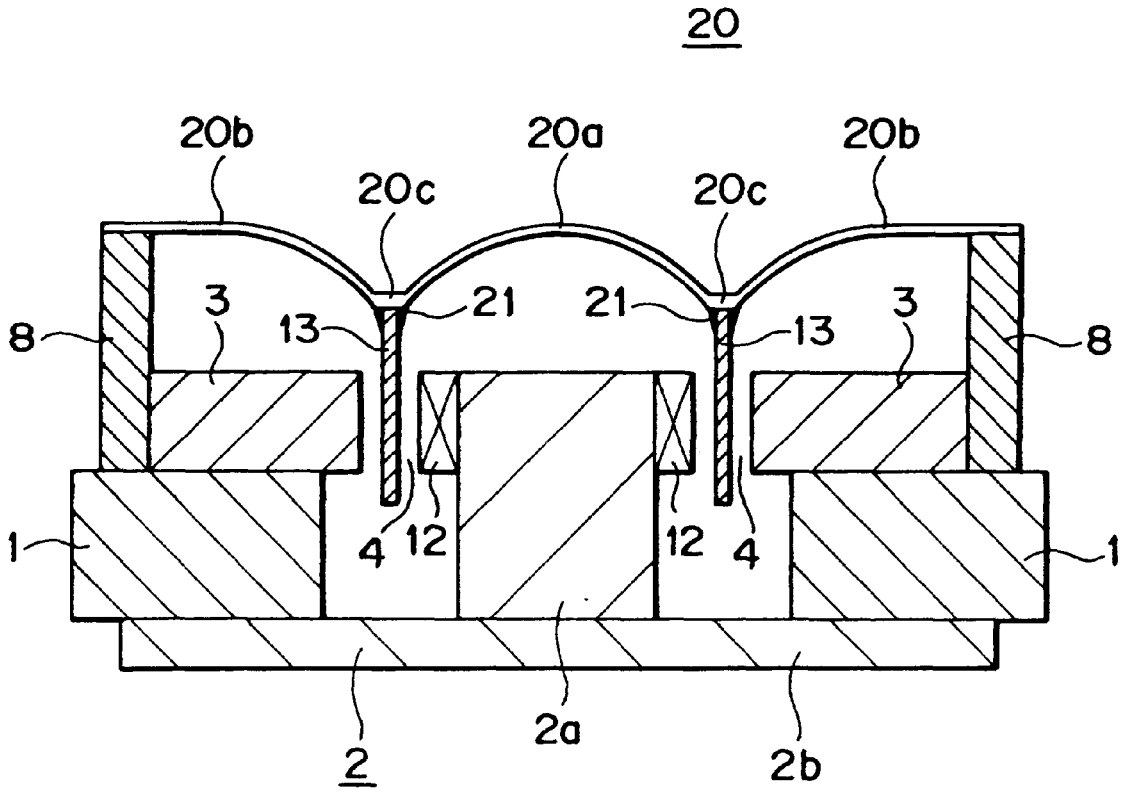
FIG. 1 is a sectional view of an exemplary embodiment representing a speaker device of the present invention.

The example of FIG. 1 shows an embodiment where the present invention is applied to an electromagnetic induction type speaker device. A magnetic circuit in this speaker device includes a doughnut-shaped magnet 1, first and second magnetic yokes 2 and 3 each composed of a magnetic material such as iron, and a magnetic gap 4. The first magnetic yoke 2 includes a cylindrical center pole 2*a* and a discoidal flange 2*b* orthogonal to the center pole 2*a*.

The second magnetic yoke 3 is termed a plate which is shaped like a doughnut whose inside diameter is greater than the outside diameter of the center pole 2*a* by a length corresponding to the magnetic gap 4.

In a state where the center pole 2*a* is inserted into the inner hollow portion of the magnetic 1 and the inner hollow portion of the plate 3, the magnet 1 is attached fixedly while being held between the upper surface of the flange 2*b* and the lower surface of the plate 3. The contact portions of the magnet 1 are bonded to the upper surface of the flange 2*b* and the lower surface of the plate 3.

A speaker diaphragm 20 in the speaker device of this embodiment is composed of a selected acoustic diaphragm material such as polyethylene terephthalate having an acoustic loss coefficient (tan δ) of more than 0.02 in a frequency band over 20 kHz, and it is formed integrally of a dome 20*a* which is positioned at the center and is shaped to be substantially arcuate in its cross section, and an edge 20*b* positioned outside the dome 20*a* adjacently thereto through a link 20*c*.

Figure 2A:
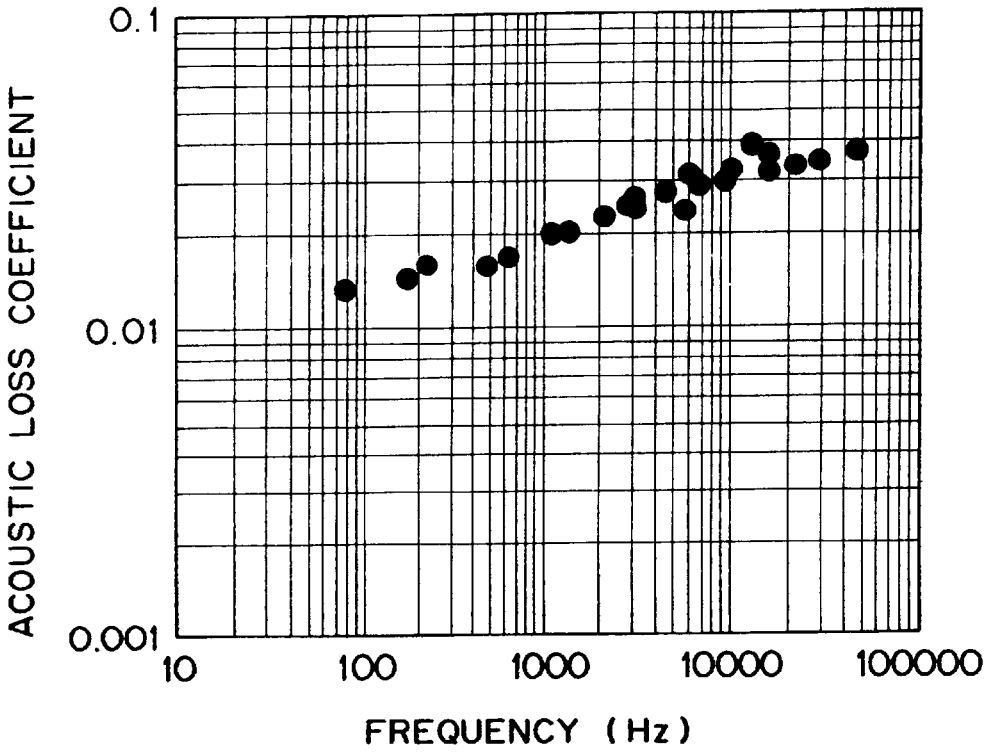
FIGS. 2A and 2B are graphs for explaining the characteristics of the present invention.

The frequency characteristic of such polyethylene terephthalate with respect to its acoustic loss coefficient is such as shown in FIG. 2A. The acoustic loss coefficient in a frequency band over 20 kHz is in a range of 0.03 to 0.04 which is higher than 0.02.

In this embodiment, an upper end face of a cylindrical conductive one-turn ring 13 is bonded fixedly with a bonding agent 21 to the link 20*c* between the dome 20*a* and the edge 20*b* of the speaker diaphragm 20, and the conductive one-turn ring 13 is inserted into the magnetic gap 4 formed between the plate 3 and the center pole 2*a*.

In this case, the end face is shaped to be relatively large in width (large in thickness) so as to reduce the electric resistance of the conductive one-turn ring 13, and the mechanical strength of the link 20*c* can be increased by equalizing the width of the end face to that of the link 20*c* between the dome 20*a* and the edge 20*b* of the speaker diaphragm 20.

Also in the example of FIG. 1, a peripheral end of the edge 20*b* of the speaker diaphragm 20 is bonded fixedly to a speaker frame 8. Further a driving coil 12 is wound around the periphery of the center pole 2*a* at a position corresponding to the gap 4, and acoustic signals are supplied to the driving coil 12.

In the speaker device of FIG. 1, the conductive one-turn ring 13 is vibrated by the action of electromagnetic induction caused due to supply of acoustic signals to the driving coil 12, hence vibrating the speaker diaphragm 20 to emit sound therefrom.

Figure 2B:
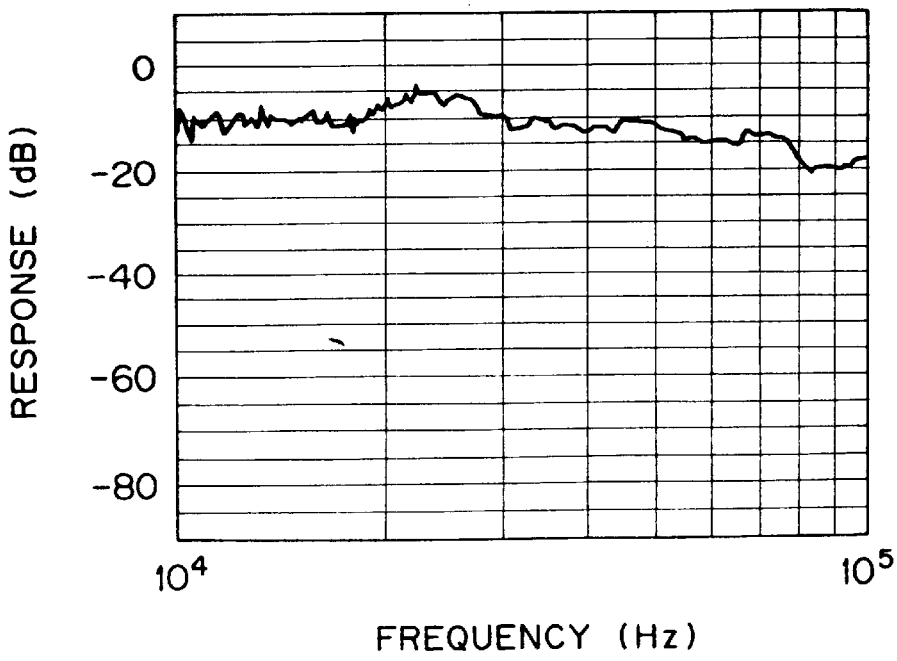

In this case, the speaker diaphragm 20 used in this embodiment is composed of polyethylene terephthalate having an acoustic loss coefficient of 0.03–0.04 in a frequency band over 20 kHz, so that the sound pressure-to-frequency characteristic is so improved as to diminish the peak dip of the sound pressure derived from the split vibrations of the speaker diaphragm 20 in a frequency band over 20 kHz, as shown graphically in FIG. 2B.

Further, since the end face of the conductive one-turn ring 13 is bonded fixedly with the bonding agent 21 to the link 20*c* between the dome 20*a* and the edge 20*b* of the speaker diaphragm 20, the mechanical strength of the link 20*c* can be increased to consequently eliminate undesired vibrations that may otherwise be caused, with 180° phase difference, in the dome 20*a* and the edge 20*b* while the link 20*c* acts as a node, hence ensuring high-quality reproduction of the acoustic signals in a frequency band over 20 kHz.

Figure 3A:
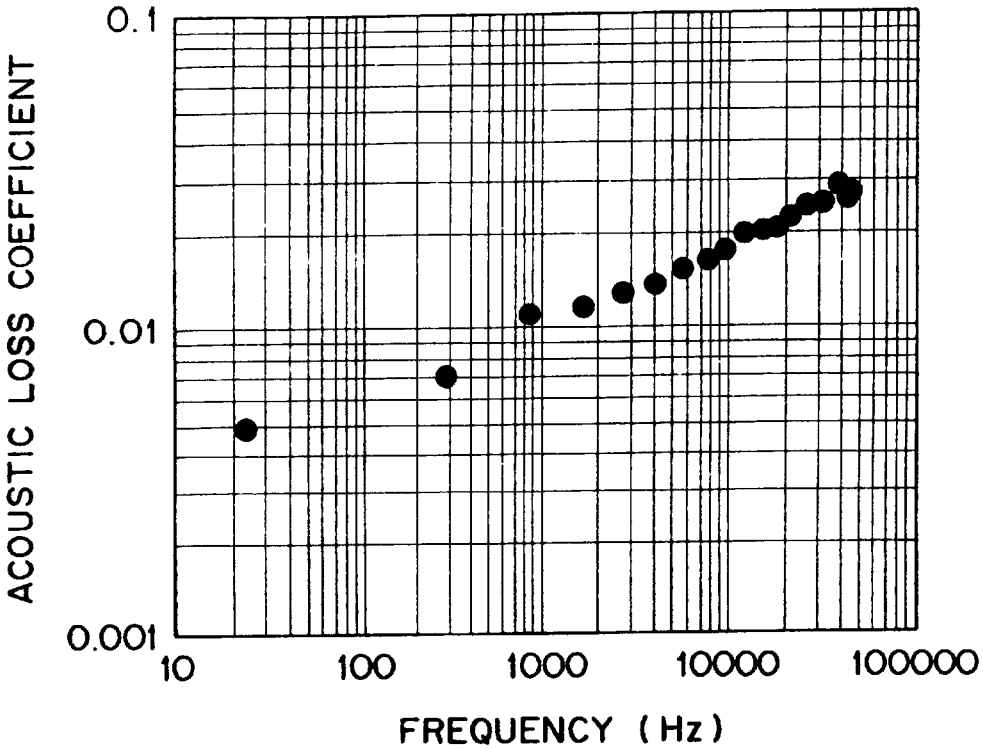
FIGS. 3A and 3B are graphs for explaining the characteristics of the invention.
Figure 3B:
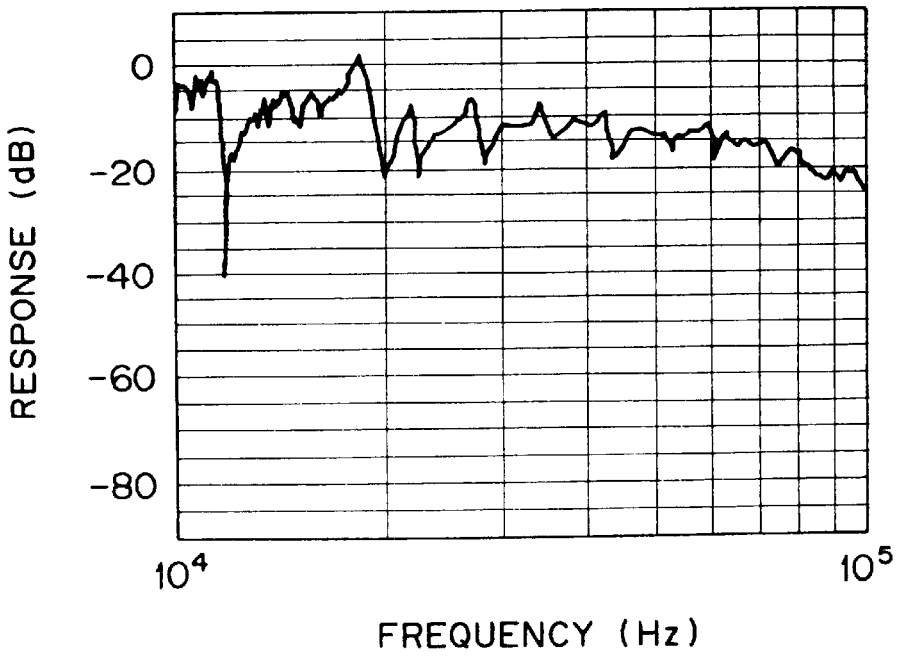

Meanwhile in any speaker device structurally equal to the embodiment of FIG. 1, if the speaker diaphragm 20 is composed of polycarbonate having an acoustic loss coefficient of 0.02–0.03 in a frequency band over 20 kHz as shown graphically in FIG. 3A for example, then the sound pressure-to-frequency characteristic of the speaker device becomes such as shown in FIG. 3B, where a peak dip appears in a frequency band under 20 kHz with an acoustic loss coefficient of less than 0.02, but satisfactory sound pressure-to-frequency characteristic is obtained in a frequency band over 20 kHz.

Figure 4A:
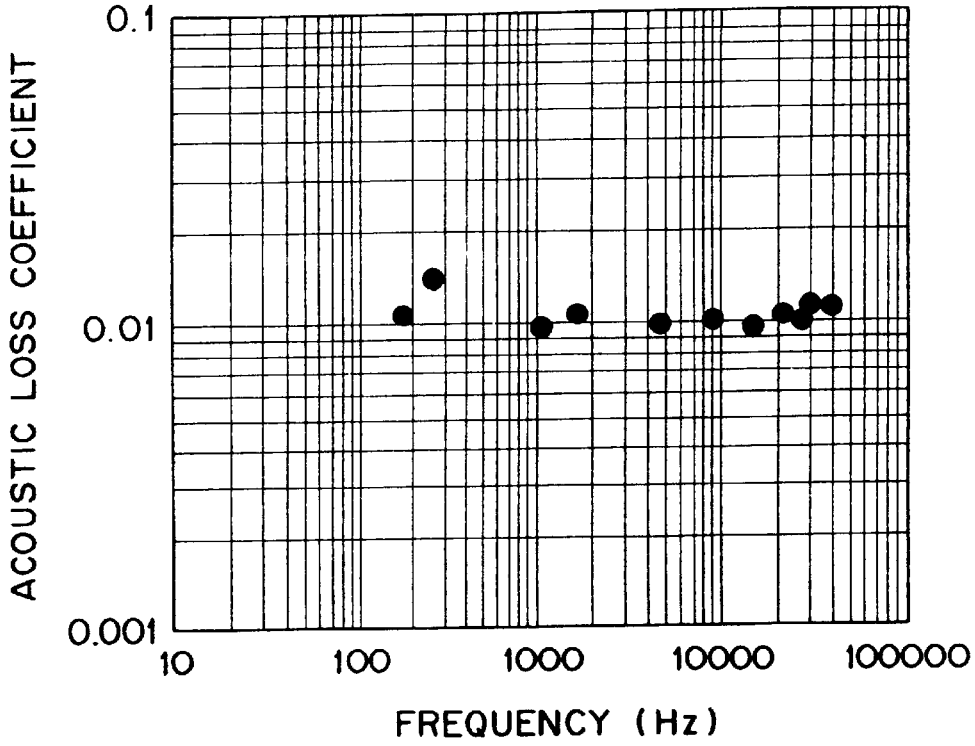
FIGS. 4A and 4B are also graphs for explaining the characteristics of the invention.
Figure 4B:
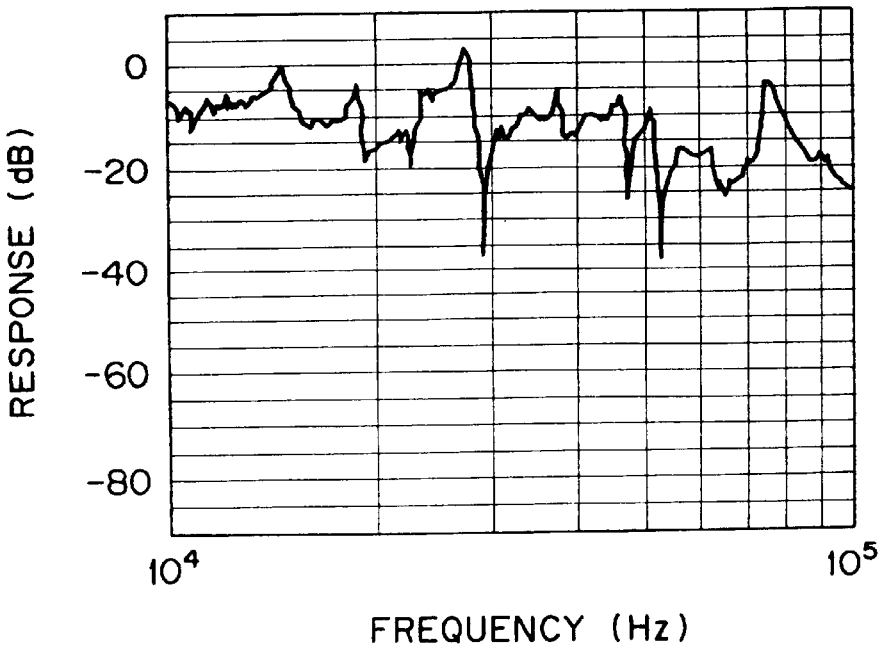

Also in any speaker device structurally equal to the embodiment of FIG. 1, if the speaker diaphragm 20 is composed of polyether imide having an acoustic loss coefficient of 0.009–0.015, which is less than 0.02, in a frequency band over 20 kHz as shown in FIG. 4A for example, then the sound pressure-to-frequency characteristic of this speaker device becomes such as shown in FIG. 4B, where there is indicated a disadvantage that a relatively great peak dip occurs in a frequency band over 20 kHz.

Figure 5:
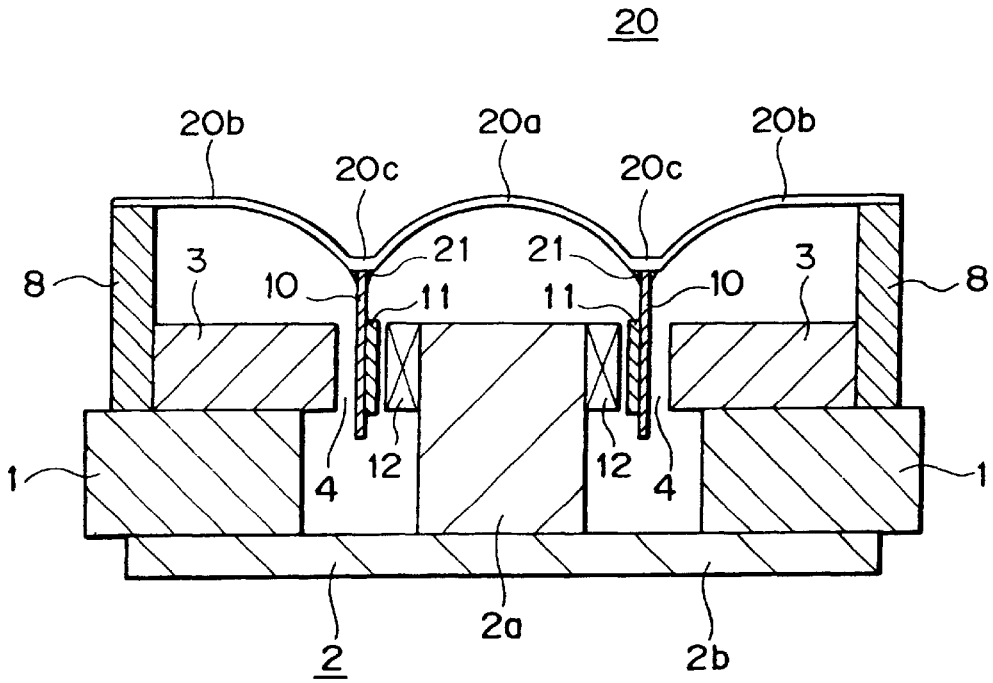
FIG. 5 is a sectional view showing another embodiment of the invention.
Figure 6:
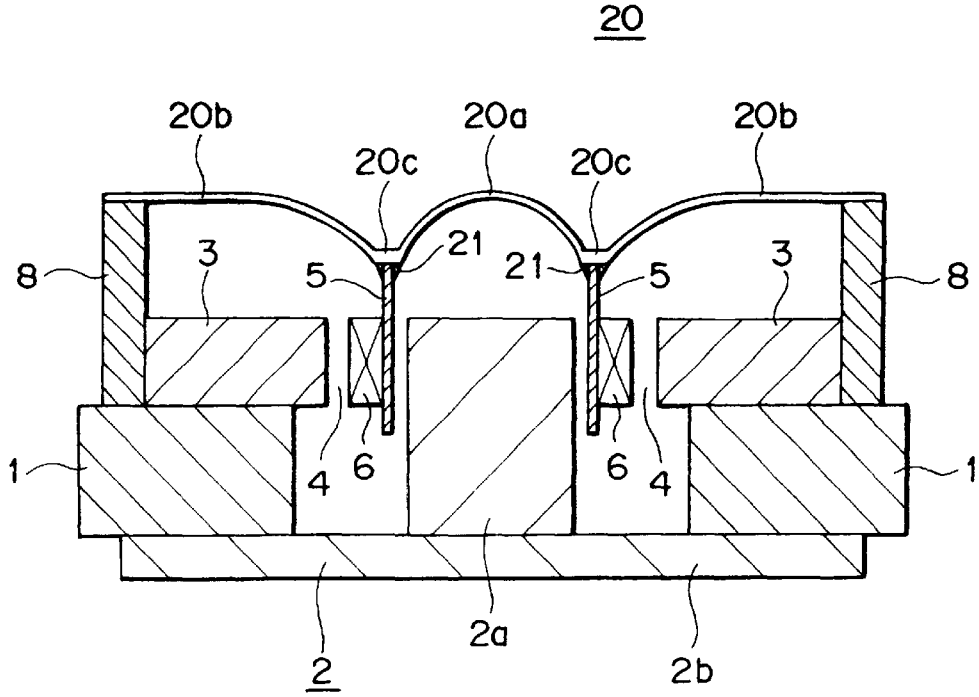
FIG. 6 is a sectional view showing a further embodiment of the invention.

FIGS. 5 and 6 show other embodiments of the present invention respectively. In the examples of FIGS. 5 and 6, any component parts corresponding to those shown in FIGS. 1, 7 and 8 are denoted by the same reference numerals, and detailed explanations thereof will be omitted below.

In the example of FIG. 5, an upper end of a cylindrical bobbin 10 composed of a non-conductor is bonded fixedly to a link 20*c* between a dome 20*a* and an edge 20*b* of a speaker diaphragm 20 similarly to the foregoing example of FIG. 1, and a conductive one-turn ring 11 adhered to a predetermined position on the inner peripheral face of the bobbin 10 is inserted into a magnetic gap 4 formed between a plate 3 and a center pole 2*a*.

In this case, the link 20*c* between the dome 20*a* and the edge 20*b* of the speaker diaphragm 20 is coated with a bonding agent 21 in the entire width thereof so as to bond the upper end of the bobbin 10 fixedly, thereby further increasing the mechanical strength of the link 20*c*.

Other component parts in the example of FIG. 5 are structurally the same as those in the aforementioned example of FIG. 1.

It will be understood with ease that, in this example of FIG. 5 also, similar functional effects are attainable as in the foregoing example of FIG. 1.

FIG. 6 shows an embodiment representing a dynamic speaker device. The driving coil 12 used in the example of FIG. 1 is removed, and an upper end of a voice coil bobbin 5 composed of a non-conductor is bonded fixedly to a link 20*c* between a dome 20*a* and an edge 20*b* of a speaker diaphragm 20 similarly to the example of FIG. 1. Further, a voice coil 6 wound around the voice coil bobbin 5 at its predetermined position is inserted into a magnetic gap 4 between a plate 3 and a center pole 2*a*, and acoustic signals are supplied to the voice coil 6. Other component parts are structurally the same as those in FIG. 1.

In the speaker device of FIG. 6, a current is caused to flow in the voice coil 6 as an acoustic signal is supplied to the voice coil 6, so that the speaker diaphragm 20 is vibrated by the interaction of the voice coil 6 and the magnetic flux in the gap 4, hence emitting sound therefrom.

In the example of FIG. 6 also, the speaker diaphragm 20 is composed of a selected acoustic diaphragm material having an acoustic loss coefficient of more than 0.02 in a frequency band over 20 kHz as in the example of FIG. 1, thereby improving the sound pressure-to-frequency characteristic in a manner to diminish the peak dip of the sound pressure derived from the split vibrations of the speaker diaphragm in a frequency band over 20 kHz.

Moreover, since the upper end of the voice coil bobbin 5 is bonded fixedly with the bonding agent 21 to the link 20*c* between the dome 20*a* and the edge 20*b* of the speaker diaphragm 20, the mechanical strength of the link 20*c* is increased to consequently eliminate undesired vibrations with 180° phase difference that may otherwise be generated in the dome 20*a* and the edge 20*b* while the link 20*c* acts as a node, hence realizing satisfactory high-quality reproduction of signals in a frequency band over 20 kHz.

It is a matter of course that the present invention is not limited to the preferred embodiments described hereinabove, and a variety of other structural changes and modifications will be apparent to those skilled in the art without departing from the spirit of the invention.

What is claimed is:

1. A speaker device comprising:

a speaker diaphragm composed of an acoustic diaphragm material having an acoustic loss coefficient (tan δ) of more than 0.02 in a frequency band over 20 kHz and including a dome positioned at a center of the diaphragm and shaped to be substantially arcuate in cross section and an edge positioned outside the dome and formed integrally therewith through a link; and a conductive one-turn ring inserted into a magnetic gap and bonded fixedly at one end thereof to the link between the dome and the edge of said speaker diaphragm, wherein signals of a frequency band over 20 kHz are reproduced by utilizing split vibrations of said speaker diaphragm.

2. A speaker device comprising:

a speaker diaphragm composed of an acoustic diaphragm material having an acoustic loss coefficient (tan δ) of more than 0.02 in a frequency band over 20 kHz and including a dome positioned at a center of the diaphragm and shaped to be substantially arcuate in cross section and an edge positioned outside the dome and formed integrally therewith through a link; and a bobbin having one of a wound voice coil and an adhered conductive one-turn ring disposed in a magnetic gap and bonded fixedly, at one end thereof, to the link between the dome and the edge of said speaker diaphragm, wherein signals of a frequency band over 20 kHz are reproduced by utilizing split vibrations of said speaker diaphragm.

* * * * *